US006186107B1

(12) United States Patent
Navalon Carretero

(10) Patent No.: US 6,186,107 B1
(45) Date of Patent: Feb. 13, 2001

(54) HEATING GLOW PLUGS CONTROLLER FOR DIESEL ENGINES

(75) Inventor: D. Herminio Navalon Carretero, Motilla del Palancar (ES)

(73) Assignee: Nagares, S.A., Cuenca (ES)

( * ) Notice: Under 35 U.S.C. 154(b), the term of this patent shall be extended for 0 days.

(21) Appl. No.: 09/330,782

(22) Filed: Jun. 11, 1999

(30) Foreign Application Priority Data

Jun. 12, 1998 (ES) ..... 9801243

(51) Int. Cl.[7] ..... F02P 19/02

(52) U.S. Cl. ..... 123/145 A; 123/179.6; 361/264

(58) Field of Search ..... 123/169 PB, 620, 123/641, 643, 605, 618, 145 A, 179.6, 179.21; 361/56, 58, 86, 91, 264, 265

(56) References Cited

U.S. PATENT DOCUMENTS 3,882,840 * 5/1975 Adamian et al. ..... 123/644
4,369,756 * 1/1983 Ezoe ..... 123/620
4,457,286 * 7/1984 Katayama et al. ..... 123/612
5,529,046 * 6/1996 Werner et al. ..... 123/643

FOREIGN PATENT DOCUMENTS

964154 A2 * 12/1999 (EP) .

* cited by examiner

*Primary Examiner*—Andrew M. Dolinar
*Assistant Examiner*—Hieu T. Vo
(74) *Attorney, Agent, or Firm*—Helfgott & Karas, P C.

(57) ABSTRACT

The heating glow plug controller for diesel engines is capable of controlling the activation of the glow plugs and consists of a set of electronic relays which in addition can also detect failures due to open circuit or short-circuit, and then acting in under 1 millisecond since electronic relays are semiconductors and no electromechanical elements are involved. There is one electronic relay per glow plug and each one may consist of a separate semiconductor wafer or alternatively, several relays may be integrated in a single semiconductor wafer. The set of relays is in turn connected to controlling or calculating module, and may even be included in the same block as the calculator module or in a different one connected by connectors and leads to the calculator block.

11 Claims, 2 Drawing Sheets

HEATING GLOW PLUGS CONTROLLER FOR DIESEL ENGINES

OBJECT OF THE INVENTION

The present invention refers to an electronic device intended for controlling the heating glow plugs in internal combustion engines of the diesel type.

The control performed by the glow plug controlling device also allows detection of failures which may be produced in glow plugs such as open circuit and short-circuit, which makes it a safety and control measure which, in the event these situations arise, prevents damage to the leads, connectors and the device itself.

BACKGROUND OF THE INVENTION

To perform the control function, electromechanical relays are being used which make it possible to stop current flow through the glow plug in the event a short-circuit is detected.

However, these electromechanical relays have a high response time, on the order of several milliseconds, so they are not able to open the circuit with the speed required, and damages due to overcurrents may occur in the few milliseconds in which the relay is still closed and the short-circuit exists.

Certain known control devices of this type already incorporate semiconductors to reduce the response time, such as those presented in U.S. Pat. Nos. 5,122,968 and 4,500,775 and German patents nos. 38.06.649 and 40.04.400.

In some of these known devices, the glow plugs are connected in parallel whether in groups or the entire set, making diagnosis of failures difficult precisely because of this connection.

DESCRIPTION OF THE INVENTION

With the heating glow plug controller for diesel engines, response times to minor short-circuits of under 1 millisecond are achieved, which removes any possibility of damages to the electrical system of the vehicle or to the device itself in the event of this type of accident.

This quick response in order to open the circuit is achieved by making the element performing this action be an electrical component with very short commutation times, which acts as an electronic relay, one of these elements existing per glow plug. The current flowing through each of these is probed, so that a short-circuit or open circuit may be detected, in which case a status line informs of the breakdown.

Each of the electronic relays consists of a power transistor performing the functions of the relay itself, and a set of electronic components for its control and failure detection.

The glow plug controller therefore consists of a set of electronic relays, one per glow plug existing in the engine; there may be any number of glow plugs depending on the number of cylinders, although the most common situation is four glow plugs for conventional passenger cars.

The set of electronic relays is connected to a calculator module which determines the need or not to connect the glow plugs and prepares the information for the breakdown diagnosis.

The glow plug controller is made of integrated electronic components in which the functions of control, diagnosis and power are carried out., allowing this device to be compact and easily handled, occupying a minimal space in the vehicle.

The controller which is the object of this invention has been designed to work with all presently existing models of heating glow plugs for diesel engines.

DESCRIPTION OF THE DRAWINGS

In order to complete the description being given and to aid a better understanding of the characteristics of the invention, attached to this descriptive memory and as an integral part of the same is a set of drawings in which with an illustrative and non-limiting nature the following is represented.

PREFERRED EMBODIMENT OF THE INVENTION

The glow plug controller basically consists of a set of relays (1) powered by the battery voltage (Vbatt), and is composed of individual electronic relays (T1–T4), one for each glow plug or load (R1–R4) existing, which close the circuit.

The set of relays (1) is connected to the calculator module (2) which may also be called the controller module since it can determine the need for connection of loads (R1–R4) or not, in addition to preparing the information of breakdown diagnosis to make it visible to the driver or even to the repair garage.

Each of the electronic relays (T1–T4) may be integrated in a semiconductor wafer or optionally, more than one or all may be integrated in a single integrated wafer.

The set of relays (1) form a block which is independent of the calculator module (2), each of them being located in a box and the two connected by connectors or leads, although as an option they could also be included in a single box forming a single block (3) in order to obtain a smaller sized device.

Also reaching the set of relays (1) is the control signal (in) from the calculator module (2), which is a low intensity logic signal which can control the status of the electronic relays (T1–T4) and therefore the flow of the activation current through the loads or glow plugs (R1–R4).

The set of relays (1) provides the diagnosis signal (status) which is a logic output signal triggered by a low level in this implementation of the invention, but which could be triggered by a high level in another embodiment of the same. This signal shows whether the glow plugs are working correctly or not or if there has been a breakdown in one of them, whether this be a short-circuit or an open circuit, in which case this diagnosis signal (status) will have a low level. This signal is sent to the calculator block (2) so that this block informs the driver of the vehicle of the breakdown status if this occurs.

Figure 1:
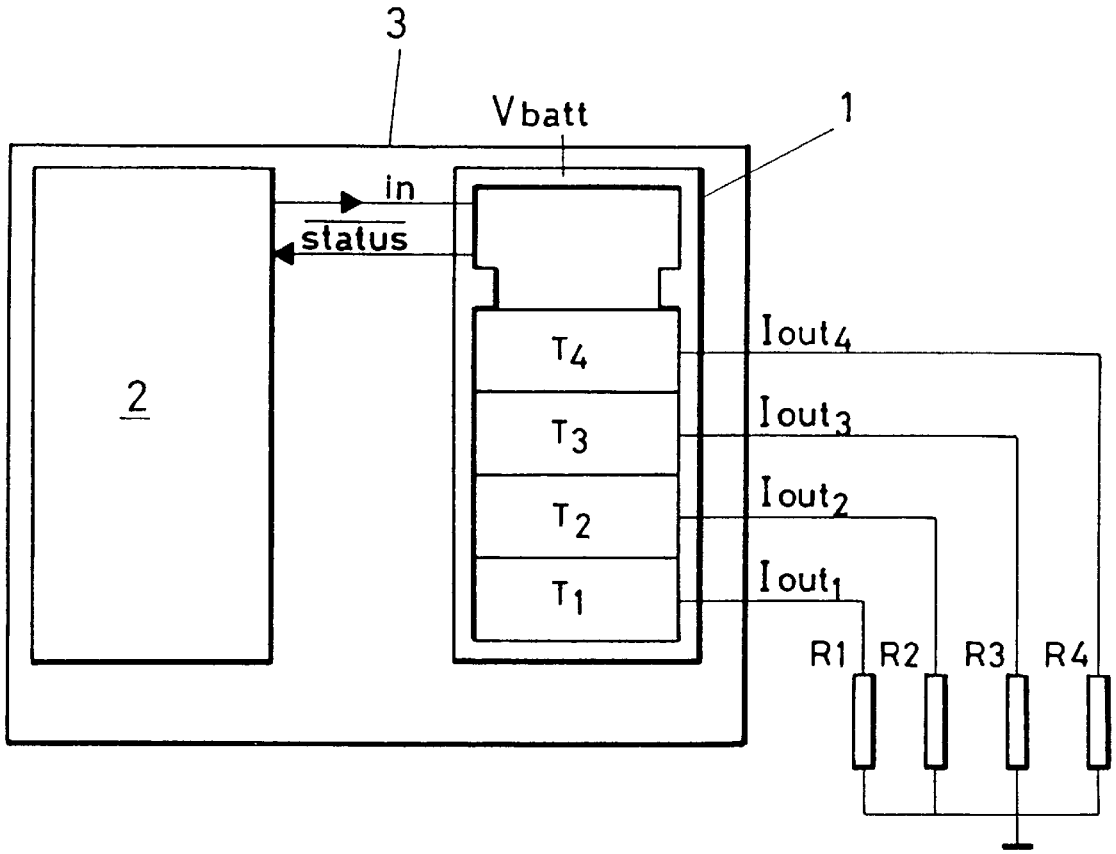
FIG. 1 shows a schematic representation of the set of relays which control the loads, together with the calculator block to which they are connected.

In the preferred embodiment of the invention, a single control signal (in) and single diagnosis signal (status) are available, but as shown in FIG. 1, optionally a diagnosis signal (status) could be available for each of the electronic relays (T1–T4) and even several diagnosis signal for each one, so that it may be known whether the breakdown in each of the glow plugs is caused by an open circuit or a short-circuit.

Figure 2:
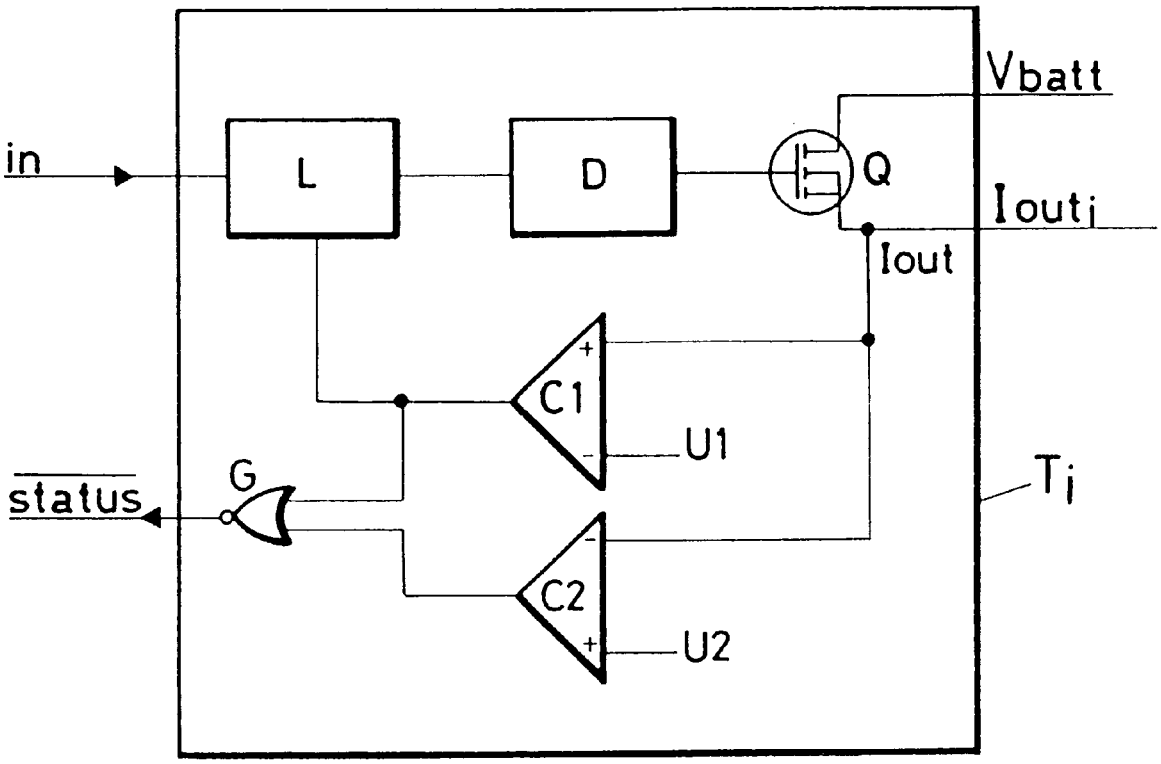
FIG. 2 is an internal block diagram of each of the electronic relays.

In FIG. 2 can be seen the internal circuit (T1) of which each electronic relay consists (T1–T4), where it is shown that the element which opens or closes each electronic relay (T1–T4) is a transistor (Q), a MOSFET power transistor. Each of these transistors (Q) has its drain connected to the positive pole of the battery (Vbatt) and out of the source comes the output current ($Iout_i$) towards the corresponding load (R1–R4) which is the rated working current for the glow plugs.

Two operational amplifiers are used as comparators, the short-circuit comparator (C1) used to detect a short-circuit and the open circuit comparator (C2) used to detect this breakdown.

For this reason the output current ($Iout_i$) is taken to the non inverting input of the comparator (C1) where it is compared to a reference signal (U1) connected to the inverting input. In a normal working status the reference signal (U1) is greater than ($Iout_i$) so that at the comparator (C1) output there is a low level, but when a short-circuit occurs ($Iout_i$) increases considerably, making the voltage at the non inverting input greater than that at the inverting one and therefore the short-circuit comparator (C1) output produces a high level signal indicating the short-circuit status.

Similarly, to detect an open circuit failure current ($Iout_i$) is taken to the inverting input of the open circuit comparator (C2) and the reference signal (U2) is taken to the inverting input. In normal operation, the output of the comparator will be a low level, since the voltage produced by current ($Iout_i$) in this input is greater than the reference signal (U2). In the event of a failure due to an open circuit, reference signal (U2) will be greater than current ($Iout_i$) so that the output of the comparator will have a high level, indicating this failure.

The outputs of both comparators are taken to the inputs of a NOR logical gate, labeled (G) in FIG. 2; the output of this gate constitutes the diagnosis signal (status) of each electronic relay ($T_i$), or optionally the connection of all of these make up the general diagnosis (status) output for the set of relays (1).

In this way, the diagnosis signal (status) will be a high level in normal operation of the glow plugs, and shall become a low level whenever there is a failure in any of them due to an open circuit or a short-circuit, informing the calculator module (2) of this event.

The output of the short-circuit comparator (C1) is also taken to the logic control block (L), which also receives the control input (in) common to all relays (T1–T4). This logic control block (L) basically consists of a bi-stable, so that when this control input allows it, transistor (Q) is activated, making it conduct via the driver (D).

The output of the short-circuit comparator (C1) interferes in the bi-stable, so that in the event of a short-circuit the control logic block (L) places transistor (Q) in the cut-off regime even if the control signal (in) is still active, and therefore stops current flow through the corresponding glow plug, to prevent damage to the electrical system and the semiconductor itself or any other component of the device.

The diagnosis signal (status) will thereby show a high level, i.e. will be inactive, while the glow plug corresponding to that signal has a current flow lower than an estimated upper current limit, so that a current greater than this limit shall be interpreted as a short-circuit, which will also transistor (Q) to be cut-off, and it will also be inactive while the current flow through the glow plug is above a certain estimated lower limit, so that a current below this limit is interpreted as an open circuit.

These upper and lower limits are set respectively by the reference signals (U1) and (U2), the value of which may vary for the different glow plug models depending on their manufacturing characteristics.

Driver (D) is needed to govern transistor (Q), since this is a power transistor requiring a high excitation voltage to be in the conducting regime.

What is claimed is:

1. A heating glow plug controller for diesel engines for detecting failures due to open circuit or short-circuit conditions and having a response time of under 1 millisecond, said controller comprising:

a plurality of electronic relays for controlling a plurality of glow plugs, each relay of said plurality being adapted to control a corresponding glow plug from said plurality, and being further adapted to detect possible failures of open circuit or short-circuit conditions in current flow to said plurality of glow plugs , and a calculator module connected to said plurality of electronic relays, said plurality of electronic relays being further adapted to provide a diagnosis signal to said calculator module for indicating the operation of said glow plugs, said calculator module being further adapted to transmit said possible failures of open circuit or short-circuit conditions to a user, and said calculator module being further adapted to determine the need to connect said glow plugs and to transmit such need via a control signal to said plurality of electronic relays for controlling the activation of each of said plurality of electronic relays.

2. A heating glow plug controller in accordance with claim 1, further comprising:

a MOSFET power transistor for commutation of each of said plurality of electronic relays, said MOSFET power transistor powered by a battery voltage and providing a current for each of said glow plugs, a short-circuit comparator for comparing said current for each of said glow plugs to a first reference signal and generating a first output level, said first output level being a high level when a short-circuit is produced, an open-circuit comparator for comparing said current for each of said glow plugs to a second reference signal and generating a second output level, said second output level being a high level when an open circuit failure occurs, a NOR gate for receiving said first and second output levels and for generating said diagnosis signal for each of said plurality of electronic relays, said diagnosis signal also comprising a general diagnosis signal for said plurality of electronic relays, and a logic control block for receiving said control signal and said first output level, wherein said logic control block is adapted through a driver to place said power transistor in cut-off upon the occurrence of a short-circuit condition.

3. A heating glow plug controller in accordance with claim 1, wherein each of said plurality of electronic relays are made in a single integrated wafer.

4. A heating glow plug controller in accordance with claim 1, wherein said plurality of electronic relays are made in a single integrated wafer.

5. A heating glow plug controller in accordance with claim 1, wherein said plurality of electronic relays and said calculator module are placed in different boxes.

6. A heating glow plug controller in accordance with claim 1, wherein said plurality of electronic relays and said calculator module are placed in the same box.

7. A heating glow plug controller for diesel engines for detecting failures due to open circuit or short-circuit conditions and having a response time of under 1 millisecond, said controller comprising:

a plurality of electronic relays for controlling a plurality of glow plugs, each relay of said plurality being adapted to control a corresponding glow plug from said plurality, and being further adapted to detect possible failures of open circuit or short-circuit conditions in current flow to said plurality of glow plugs, and a calculator module connected to said plurality of electronic relays, said plurality of electronic relays being further adapted to provide a diagnosis signal to said calculator module for indicating the operation of said glow plugs, said calculator module being further adapted to transmit said possible failures of open circuit or short-circuit conditions to a user, and said calculator module being further adapted to determine the need to connect said glow plugs and to transmit such need via a control signal to said plurality of electronic relays for controlling the activation of each of said plurality of electronic relays, and further comprising:

a MOSFET power transistor for commutation of each of said plurality of electronic relays, said MOSFET power transistor powered by a battery voltage and providing a current for each of said glow plugs, a short-circuit comparator for comparing said current for each of said glow plugs to a first reference signal and generating a first output level, said first output level being a high level when a short-circuit is produced, an open-circuit comparator for comparing said current for each of said glow plugs to a second reference signal and generating a second output level, said second output level being a high level when an open circuit failure occurs, a NOR gate for receiving said first and second output levels and for generating said diagnosis signal for each of said plurality of electronic relays, said diagnosis signal also comprising a general diagnosis signal for said plurality of electronic relays, and a logic control block for receiving said control signal and said first output level, wherein said logic control block is adapted through a driver to place said power transistor in cut-off upon the occurrence of a short-circuit condition.

8. A heating glow plug controller in accordance with claim 7, wherein each of said plurality of electronic relays are made in a single integrated wafer.

9. A heating glow plug controller in accordance with claim 7, wherein said plurality of electronic relays are made in a single integrated wafer.

10. A heating glow plug controller in accordance with claim 7, wherein said plurality of electronic relays and said calculator module are placed in different boxes.

11. A heating glow plug controller in accordance with claim 7, wherein said plurality of electronic relays and said calculator module are placed in the same box.

* * * * *